US012760892B2

(12) United States Patent
Schiesser

(10) Patent No.: US 12,760,892 B2
(45) Date of Patent: Oct. 13, 2026

(54) ULTRA LOW NOX BURNER

(71) Applicant: MME Engineering E.U., Vienna (AT)

(72) Inventor: Roman Schiesser, Vienna (AT)

(73) Assignee: MME ENGINEERING E.U., Vienna (AT)

( * ) Notice: Subject to any disclaimer, the term of this patent is extended or adjusted under 35 U.S.C. 154(b) by 436 days.

(21) Appl. No.: 18/283,500

(22) PCT Filed: Mar. 17, 2022

(86) PCT No.: PCT/EP2022/057025
§ 371 (c)(1),
(2) Date: Sep. 22, 2023

(87) PCT Pub. No.: WO2022/200174
PCT Pub. Date: Sep. 29, 2022

(65) Prior Publication Data

US 2024/0175576 A1 May 30, 2024

(30) Foreign Application Priority Data

Mar. 23, 2021 (AT) ..... A 61/2021

(51) Int. Cl.
*F23L 9/06* (2006.01)
*F23D 14/58* (2006.01)
*F23K 5/00* (2006.01)

(52) U.S. Cl.
CPC ..... *F23L 9/06* (2013.01); *F23D 14/58* (2013.01); *F23K 5/007* (2013.01);
(Continued)

(58) Field of Classification Search
CPC ..... F23L 9/06; F23L 9/02; F23L 11/00; F23L 15/00; F23L 2900/07005; F23D 14/58;
(Continued)

(56) References Cited

U.S. PATENT DOCUMENTS 4,614,159 A * 9/1986 Sugiura ..... F23D 1/02 110/263
5,807,094 A 9/1998 Sarv
(Continued)

FOREIGN PATENT DOCUMENTS

DE 1601280 A1 11/1970

OTHER PUBLICATIONS

International Search Report issued Aug. 1, 2022 in PCT/EP2022/057025.

*Primary Examiner* — David J Laux
(74) *Attorney, Agent, or Firm* — Panitch Schwarze Belisario & Nadel LLP

(57) ABSTRACT

A burner includes a hot gas zone and an outer zone, a primary air feed line, a secondary air feed line, and a fuel feed line. The secondary air feed line includes three concentric cylindrical tubes. The fuel feed line is arranged concentrically around the secondary air feed line. A first dead volume exists inside the burner between the secondary air feed line and the fuel feed line. The fuel feed line has a nozzle construction on the hot gas side. A second dead volume is arranged between the secondary air feed line and the fuel feed line on the outer side zone. The primary air feed line is arranged concentrically around the fuel feed line.

18 Claims, 13 Drawing Sheets

(52) U.S. Cl.
CPC .... *F23D 2203/007* (2013.01); *F23D 2204/20* (2013.01); *F23D 2900/14021* (2013.01); *F23J 2215/101* (2013.01); *F23K 2400/201* (2020.05)

(58) Field of Classification Search
CPC ..... F23D 2203/007; F23D 2204/20; F23D 2900/14021; F23D 2900/11403; F23D 14/24; F23D 14/04; F23D 14/08; F23D 14/085; F23D 14/48; F23D 14/64; F23D 14/66; F23D 2204/10; F23D 2214/00; F23K 5/007; F23K 2400/201; F23J 2215/101; F23J 11/00; F23J 15/00; F23J 99/00; F23J 2215/10; F23J 2215/40; F23J 2219/00; F23J 2219/20; F23J 2900/15081; F23C 9/00; F23C 9/08
See application file for complete search history.

(56) References Cited

U.S. PATENT DOCUMENTS

| | | | | |
|---|---|---|---|---|
| 6,652,268 | B1 | 11/2003 | Irwin et al. | |
| 2013/0125798 | A1* | 5/2013 | Taylor | F23D 1/005 110/213 |
| 2013/0255551 | A1* | 10/2013 | Xue | F23D 1/005 110/297 |
| 2014/0182491 | A1* | 7/2014 | Xue | F23G 7/10 110/297 |
| 2019/0093881 | A1* | 3/2019 | Risseeuw | F23D 14/24 |

* cited by examiner

ULTRA LOW NOX BURNER

CROSS-REFERENCE TO RELATED APPLICATIONS

This application is a Section 371 of International Application No. PCT/EP2022/057025, filed Mar. 17, 2022, which was published in the German language on Sep. 29, 2022, under International Publication No. WO 2022/200174 A1, which claims priority under 35 U.S.C. § 119 (b) to Austrian Application No. A 61/2021, filed Mar. 23, 2021, the disclosures of each of which are incorporated by reference herein.

This invention relates to a burner producing an exhaust gas with a low NOx content as well as a method for burning fuel with a low percentage of NOx in the exhaust gas.

Nitrogen oxides, chemically represented by the general formula NOx for various nitrogen oxides, are an environmentally damaging exhaust gas for which there are strict emission limits in place. Nitrogen oxides NOx form at high combustion temperatures from the air's nitrogen $N_2$. These limits must be complied with under all circumstances. The NOx limits can be met either on the burner side by controlling the fuel combustion and the air supply or on the exhaust gas side by subsequent removing of NOx formed during combustion.

STATE OF THE ART

Various types of burners have been described in literature, some of which achieve a low NOx concentration in the exhaust gas.

DE102004059888A1 describes a burner for pulverized, liquid and gaseous fuels with a tubular primary air and dust supply forming a primary air and dust nozzle at its front end, a surrounding ring-shaped secondary air supply with a ring-shaped secondary air nozzle through which part of the combustion air can be introduced in a swirled manner, a ring-shaped tertiary air nozzle ring, which is arranged outside of the secondary air supply, and a conical quarl, wherein the conical quarl is directly attached to the secondary air nozzle and shaped as a semi-combustor, and the tertiary air nozzle ring is arranged outside of the conical funnel-shaped opening of the quarl and comprises several individual nozzles.

DE112011103913T5 describes a boiler system fired with fuel dust in which a first nozzle, which injects fuel dust to a furnace wall of a furnace, and a second nozzle, which injects combustion air for high-temperature combustion, are alternately arranged in a horizontal direction.

DE3623103A1 describes a continuous-flow or storage water heater with a combustion chamber heated by an atmospheric gas burner, through which heat exchange with the water occurs and which is connected to a supply air feed line and an exhaust gas discharge line via an interposed fan, wherein the exhaust gas discharge line is directly connected to the supply air feed line via a branch line.

DE3832016A1 describes a method for the combustion of liquid or gaseous fuels, wherein a mixture consisting of fuel and primary air as well as secondary air is added to this combustion, wherein a proportion of the exhaust gases produced during combustion is added to the primary air and a proportion of the fuel is added to the secondary air.

DE4133176A1 describes a burner for liquid and/or gaseous fuels, which comprises in a burner housing a primary air pipe having a fuel supply with a fuel outlet head and coaxial to the primary air pipe a secondary air pipe with a secondary air outlet at its free end, wherein the secondary air pipe limits the secondary air outlet by a secondary-air-duct reduction-ring, which tapers towards the burner axis.

DE4435640A1 describes a method for combustion of pulverized fuel, particularly coal, by means of a burner with a primary air pipe carrying a mixture of air and fuel (primary air) and a jacket air pipe, which carries jacket air and surrounds the primary air pipe, in which the primary air and swirled jacket air exit into a burner muffle while forming a primary combustion zone with an internal recirculation zone, in which, upon exit of the primary air, the concentration of coal dust in the peripheral region is disturbed creating swirls and in which the swirled staged air is fed to the primary flame, wherein the primary air flow velocity is changed before the coal dust concentration in the peripheral region is disturbed and the staged air is introduced into a ring of individual jets surrounding the primary combustion zone in such a way that a swirl is added to the total staged air.

EP2498002B1 describes an industrial burner of a thermal process plant for direct or indirect heating of a furnace chamber, which comprises a combustion chamber with at least one opening leading into a heating chamber, through which a material stream moves from the combustion chamber into the heating chamber, and at least one heat exchange device, which cools exhaust gas that is processed from the heating chamber into the heat exchange device, wherein the at least one heat exchange device extends at least partially along the combustion chamber in axial direction, wherein a heat insulation is interposed between the combustion chamber and the at least one heat exchange device.

The object of the present invention is to provide a burner that produces a low NOx content in the exhaust gas.

According to the invention, this is achieved by providing a burner comprising a hot gas zone and an outer zone, a primary air feed line, a secondary air feed line, a fuel feed line, wherein

- the secondary air feed line comprises three concentric cylindrical tubes (an innermost tube, a middle tube and an outermost tube), wherein:
  - the secondary air feed line protrudes into the hot gas zone;
  - the innermost tube is open to the outer zone and open to the hot gas zone;
  - the middle tube is arranged concentrically around the innermost tube and has a dome-shaped seal, which encloses the innermost tube on the hot gas side dome-like and is closed off towards the outer zone;
  - the middle tube comprises overflow channels, which are arranged in the outer zone, comprise holes and are open towards the outermost tube;
  - the outermost tube is closed off towards the outer zone and open to the hot gas side and comprises adjustable swirl vanes near the opening on the hot gas side at an angle of attack of 15° to 80°;
- the fuel feed line is arranged concentrically around the secondary air feed line, which ends immediately after entering the hot gas zone;
  - wherein a first dead volume exists inside the burner between the secondary air feed line and the fuel feed line and
  - wherein the fuel feed line has a nozzle construction on the hot gas side, which comprises the following:
  - a ring diaphragm with holes;
  - radially oriented injector aspiration nozzles, which are in fluid connection with the holes and, on the aspiration side, project beyond the outer diameter of the primary air feed line;

wherein the holes in the ring diaphragm have an angle of attack of 0°-60°, preferably 10°-45°, more preferably 45°, wherein the ring diaphragm forms a truncated cone with an angle of attack of 0°-70°, preferably 200-45°, wherein the base of the cone faces the outer zone;

a second dead volume is arranged between the secondary air feed line and the fuel feed line on the outer zone;

the primary air feed line is arranged concentrically around the fuel feed line, which ends immediately after entering the hot gas zone and comprises the following:

a conical taper of the diameter at the opening on the hot gas side, wherein the conical taper forms a truncated cone having an angle of 0°-20°;

an adjustable ring diaphragm at the opening of the conical taper facing the hot gas side;

swirl vanes with adjustable angle of attack, arranged at an angle of 10° to 90°, preferably 40°-70°.

This design of a burner achieves effective fuel combustion with a low NOx content in the exhaust gas. The secondary air is preheated in the dome-shaped seal arranged on the hot gas side and enters the combustion chamber preheated. The swirl vanes in the outermost tube of the secondary air feed line allow the secondary air to distribute evenly around the circumference of the outermost tube, so that a uniform flow of secondary air enters the combustion chamber (i.e., the hot gas side) along the entire circumference of the opening. In addition, a vortex flow is forced by the swirl vanes, which stabilizes the flame.

The "primary air feed line" can also be called "feed line for primary air", the "secondary air feed line" can also be called "feed line for secondary air" and the "fuel feed line" can also be called "feed line for fuel".

The outermost tube of the secondary air feed line and/or the dome-shaped seal of the middle tube of the secondary air feed line may have a heat-resistant coating or may be made of a heat-resistant material, e.g., ceramic.

The nozzle construction in the fuel feed line provides an even distribution of the fuel over the entire circumference of the fuel feed line. The nozzle construction consists of a ring diaphragm with holes, through which the fuel is fed into the combustion chamber, and injector aspiration nozzles to aspirate exhaust gas from the surrounding area, which are built into this ring diaphragm. The injector aspiration nozzles are placed along the fuel flow channels. The injectors have tube shaped elongated aspiration nozzles on the aspiration side. The length of the injector aspiration nozzles on the aspiration side is longer than the width of the primary air feed line, i.e. the injector aspiration nozzles can aspirate exhaust gas from the surrounding area of the burner directly into the gaseous fuel stream. Alternatively, the injector aspiration nozzles' aspiration openings are directed inwardly and are in fluid connection with the exhaust gas volume surrounding the secondary air nozzle. The embodiment of the exhaust gas aspiration from the inside or from the outside depends on the structural conditions of the thermal processing plant to be fired, the embodiment with the extraction from the outside offering the advantage that the aspirated exhaust gas is cooled in the injectors' aspiration pipes due to the discharging primary air. The aspirated and cooled exhaust gas stream is fed into the fuel stream. As a result, a fuel-exhaust gas mixture is obtained at the outlet of the fuel nozzles, which is reacted with oxygen in a combustion reaction. The exhaust gas portion in the fuel stream has an NOx-reducing effect, because the peak temperature in the flame remains low, resulting in less thermal NOx.

The first dead volume serves as thermal insulation and can be filled with a suitable material for thermal insulation between the areas of secondary air and fuel.

The conical taper in the primary air feed line serves to accelerate the primary air stream. The adjustable ring diaphragm and the swirl vanes with the adjustable angle of attack serve to evenly distribute primary air over the entire circumference of the feed line or create a vortex structure in the discharging fluid.

In addition, by this arrangement the secondary air stream is fed into the combustion reaction with the fuel, locally offset along the longitudinal axis. Through the layout of this arrangement a staged combustion is realized based on air staging.

A burner can cover a performance range of 10 kWh to 100,000 kWh, which corresponds to an hourly natural gas consumption of 1 $m^3$ to 10,000 $m^3$. The burner can be operated with any gaseous fuel, such as natural gas, methane, ethane, propane, butane etc., as well as pulverized solid fuels, such as pulverized coal, or gasified liquid fuels, such as hydrazine.

In an embodiment of the invention, the secondary air feed line may be adjustable in length, wherein the tube-in-tube system for supplying the secondary air projects with a length L into the combustion chamber, wherein the length L may be varied according to the relation $L=D*f$ with D=outer diameter of the primary air feed line and $f=0\leq f\leq 3$. This allows the design to be adapted to the gas flow speeds (primary air, secondary air, fuel) and the combustion requirements. Particularly the concept of air staging for NOx reduction can be designed variably and optimized with regard to the highest possible NOx reduction.

In an embodiment of the invention, about ⅓ of the secondary air feed line may project into the hot gas zone. This ensures good heat transfer to the secondary air. Preheating secondary air ensures a more stable and more complete burnout of the remaining fuel.

In another embodiment of the invention, the ratio of (outer diameter of innermost tube of secondary air feed line) (hereinafter:ADi):(outer diameter of middle tube of secondary air feed line) (hereinafter:ADm):(outer diameter of outermost tube of secondary air feed line) (hereinafter:ADa) may be about 0.7-1.3:1.26-2.34:1.82-3.38, preferably about 1:1.8:2.6. This constitutes an excellent geometry that provides an improved combustion result.

In an embodiment of the invention, the second dead volume may be about ⅕ of the length of the secondary air feed line. This serves as thermal insulation between secondary air area and fuel feed line.

In an embodiment of the invention, the ratio of (inner diameter of fuel feed line) (hereinafter:IDZ):(outer diameter of fuel feed line) hereinafter:ADZ) may be about 0.7-1.3:0.98-1.82, preferably about 1:1.4. This constitutes an excellent geometry that provides an improved combustion result.

In an embodiment of the invention, the ratio of (inner diameter of primary air feed line) (hereinafter:IDP):(outer diameter of primary air feed line) (hereinafter:ADP) may be about 0.7-1.3:0.91-1.69, preferably about 1:1.3. This constitutes an excellent geometry that provides an improved combustion result.

In an embodiment of the invention, the first dead volume may hold a vacuum or a thermal insulation. This ensures that the fuel does not heat up before entering the hot gas zone.

In an embodiment of the invention, the outermost tube of the secondary air feed line may comprise overflow channels, which end in the first dead volume, and the first dead volume may comprise partitions, which reduce the first dead volume, and the ring diaphragm may be adjustable and may comprise openings on its inside. This creates a tertiary airstream that streams into the hot gas zone via an adjustable ring diaphragm on the inside of the fuel nozzle. As a result, a more efficient and more stable combustion is achieved.

In an embodiment of the invention, the radially oriented injector aspiration nozzle may comprise at least one guide plate with the same orientation as the swirl vane in the primary air feed line. This provides the primary air with an additional swirl. This further supports the formation of a vortex flow of the primary air.

In an embodiment of the invention, the outermost tube of the secondary air feed line may comprise a nozzle ring with radially or radially and axially arranged outflow openings at the outlet into the hot gas zone.

In an embodiment of the invention, tube sections may be arranged in the dome-shaped seal of the middle tube of the secondary air feed line, which project through the dome-shaped seal on one end and project through a baffle plate on the opposite end. Due to the back-flowing secondary air, exhaust gas from the combustion chamber is "taken along" by injector effect and mixed with the secondary air. This mixture of gases is burned with the fuel at the outflow openings of the secondary air feed line. The baffle plate causes the dynamic pressure required for the injector effect and the associated pressure drop on the downstream side.

In an embodiment of the invention, the cross section of the natural-gas-filled ring diaphragm has an outwardly directed cone via which the primary air flows. This geometry of the ring diaphragm forces an inwardly directed stream of primary air. Additionally, a cylindrical ring diaphragm may be fitted on the cone for better direction of the primary airstream.

In an embodiment of the invention, holes may be arranged on the inside of the ring diaphragm, which are in fluid connection with the holes in the ring diaphragm. As a result, exhaust gas is aspirated from the inside into the fuel stream via the injector aspiration nozzle.

In an embodiment, a feed line for additives may be arranged centrally along the burner axis and may project through the dome-shaped seal of the middle tube of the secondary air feed line, wherein the feed line comprises a nozzle in the hot gas zone. The feed line may also be arranged radially around the burner. Through this feed line, combustible or non-combustible additives, such as used oils and heating oils, fatty solutions of animal or plant origin, organic waste materials and solvents, waste acid and base, wastewater, sulfur-containing liquids, chlorinated and halogenated gases and liquids, may be co-combusted via this additional injection system. The substances mentioned are fed into the combustion chamber via the additional supply line, which is arranged centrally along the burner axis or radially around the burner. The additives are finely atomized and injected into the burner flame via a nozzle. Through this feed line, exhaust gas can also be extracted to the outside in counterflow to the secondary air, which preheats the secondary airstream.

In an embodiment of the invention, the outflow openings of the tube sections on the side of the baffle plates may be narrowed by a longitudinally adjustable cone (valve). This enables the regulation of the total exhaust gas mass flow in the secondary airstream.

In an embodiment, an outer annular gap may be formed by two tubes, which surround the burner on the outside, wherein the inner one of the two tubes has an opening and the outer one of the two tubes has an outlet. Through the outer annular gap, exhaust gas can be extracted to the outside through the outlet, which is arranged in the outer one of the two tubes, in counterflow to the primary air, which preheats the primary airstream. Additionally, the interior of the two tubes creates a closed combustion chamber in which the staged combustion takes place and the hot gases may discharge through the opening arranged on the inside of the two tubes.

Another aspect of the invention relates to a method for the combustion of fuel in a burner as defined above, wherein, in a burner as defined above, secondary air is fed into the secondary air feed line, wherein the secondary air is swirled by the swirl vanes; fuel is fed into the fuel feed line, wherein the fuel is injected through the holes in the ring diaphragm into the swirled primary air at an outwardly directed angle of attack; primary air is fed into the primary air feed line, wherein the primary air is swirled by the swirl vanes. This results in efficient combustion with a low NOx content in the exhaust gas.

In an embodiment of the other aspect of the invention, the portion of secondary air may be 20-50% by volume and the portion of primary air may be 50-80% by volume of all air required for combustion. This distribution ratio yields excellent exhaust gas behavior.

In an embodiment of the other aspect of the invention, the total air coefficient for the sum of primary and secondary air $\lambda$ is about 1.0 to 2.0, preferably about 1.0 to 1.5, more preferably about 1.0 to 1.1. Thus, a stoichiometric excess of air or oxygen can be used.

In an embodiment of the other aspect of the invention, the oxygen concentration in secondary air and primary may be from 21% by volume to 100% by volume. Accordingly, the nitrogen content has lower concentrations as oxygen concentrations increase. Higher oxygen concentrations allow for the far more efficient conduction of combustion processes, because combustion temperature and heat transfer based on gas radiation increase considerably with increasing oxygen concentrations in the oxidant stream. Thus, an increase in energy efficiency combined with low NOx emissions can be achieved with this burner.

In an embodiment of the method, the primary air and secondary air may be a mixture of air and exhaust gas, a mixture of air and oxygen or a mixture of exhaust gas and oxygen. Thus, a method for external exhaust gas circulation with oxygen enrichment can be realized with the present burner. In this process, an exhaust gas sub stream is diverted from the main stream, enriched with oxygen and fed to the burner at the inlets for primary and secondary air as an air replacement. The enthalpy of the recycled exhaust gas-oxygen-mass flow may be then used directly for energy conservation. Based on this concept not only NOx but also $CO_2$ emissions can be reduced drastically.

In an embodiment of the other aspect of the invention, the fuel may comprise nitrogen. Nitrogenous fuels, such as hydrazine, may be used. Hydrocarbons used as fuels may also contain small amounts of nitrogen. With this burner, these nitrogen-loaded fuels may be burned without causing noteworthy NOx emissions.

In an embodiment, the fuel may comprise or be gaseous hydrocarbons, hydrogen, biogas, mixtures of carbon dust and air, hydrogen sulfides, carbon monoxide, mixtures of carbon monoxide and hydrogen, coke-oven gas, tail gas, etc.

In one embodiment of the method, exhaust gas can be aspirated directly into the fuel stream due to the injector effect. This allows for a more efficient NOx reduction.

In one embodiment of the method, the outwardly directed injector aspiration nozzles may be cooled by the outflowing primary air. This minimizes thermal strain on the injector aspiration nozzles.

In one embodiment of the method, the aspirated exhaust gas flow may be cooled below condensation temperature (dew point) for the exhaust gas humidity inside the injector aspiration nozzles, wherein water is condensed in the exhaust gas flow and the liquid water is fed into the fuel stream. This too allows for a lower combustion temperature, which suppresses thermal NOx formation.

In an embodiment of the method, exhaust gas may be aspirated into the secondary airstream and as a result a mixture of air and exhaust gas may be combusted with the injected fuel at the secondary air nozzle opening. The introduced exhaust gas reduces the combustion temperature and therefore the NOx emissions.

In an embodiment of the method, the quantities of material flows can be controlled automatically for low NOx and CO emissions based on a rigidly functioning programmed logic or a neural network individually trained for the respective process conditions. Thus, the legal limits can easily be complied with.

The following reference numbers are used in the examples and figures:

1 Secondary air feed line
1*a* Innermost tube of secondary air feed line
1*b* Middle tube of secondary air feed line
1*c* Outermost tube of secondary air feed line
1*d* Dome-shaped seal of middle tube of secondary air feed line
1*e* Overflow channels of middle tube of secondary air feed line
1*f* Swirl vane for axial or radial swirling of secondary air
1*g* Overflow channel to first dead volume
1*h* Nozzle ring with radially or radially and axially arranged outflow openings
1*i* Injector aspiration tubes for mixing exhaust gas from the combustion chamber into the secondary airstream
1*j* Baffle plate for tapering the cross section in the return line of secondary air for injector system for mixing in exhaust gas into secondary air
1*k* Outer annular gap formed by tubes 1*m* and 1*n*
1*l* Outlet at the outer of two tubes 1*n* forming the outer annular gap 1*k*
1*m* Inner of the two tubes forming the outer annular gap 1*k*
1*n* Outer of two tubes forming the outer annular gap 1*k*
1*o* Opening at the inner of two tubes 1*m* forming the outer annular gap 1*k*
2 Fuel feed line
2*a* Additives feed line
2*b* Nozzle on additives feed line
3 Primary air feed line
4 First dead volume
4*a* Partition
5 Nozzle construction in fuel feed line
5*a* Ring diaphragm with holes
5*b* Holes in ring diaphragm for fuel supply
5*c* Injector aspiration nozzles with aspiration nozzles directed radially outwards or inwards
5*d* Opening for tertiary air in ring diaphragm
5*e* Integrated guide plates on injector aspiration nozzles
5*f* Holes on inside of ring diaphragm for exhaust gas aspiration
9 Second dead volume
10 Adjustable ring diaphragm in primary air feed line
11 Swirl blades in primary air feed line
21 Hot gas zone
22 Outer zone

FIGURES

EXAMPLES

Example 1—Burner

Figure 1:
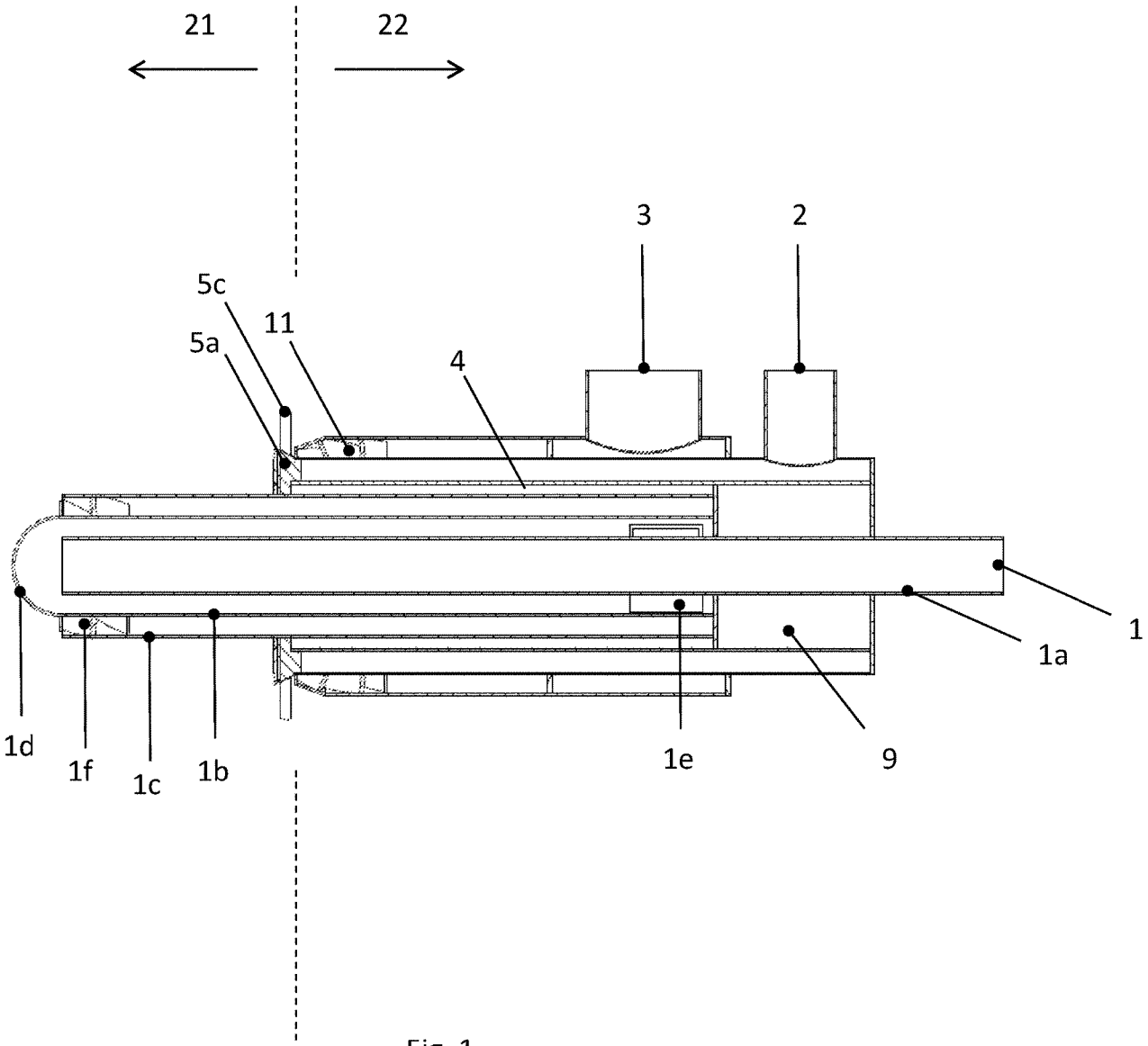
FIG. 1 depicts a cross section of a burner of the invention.
Figure 2:
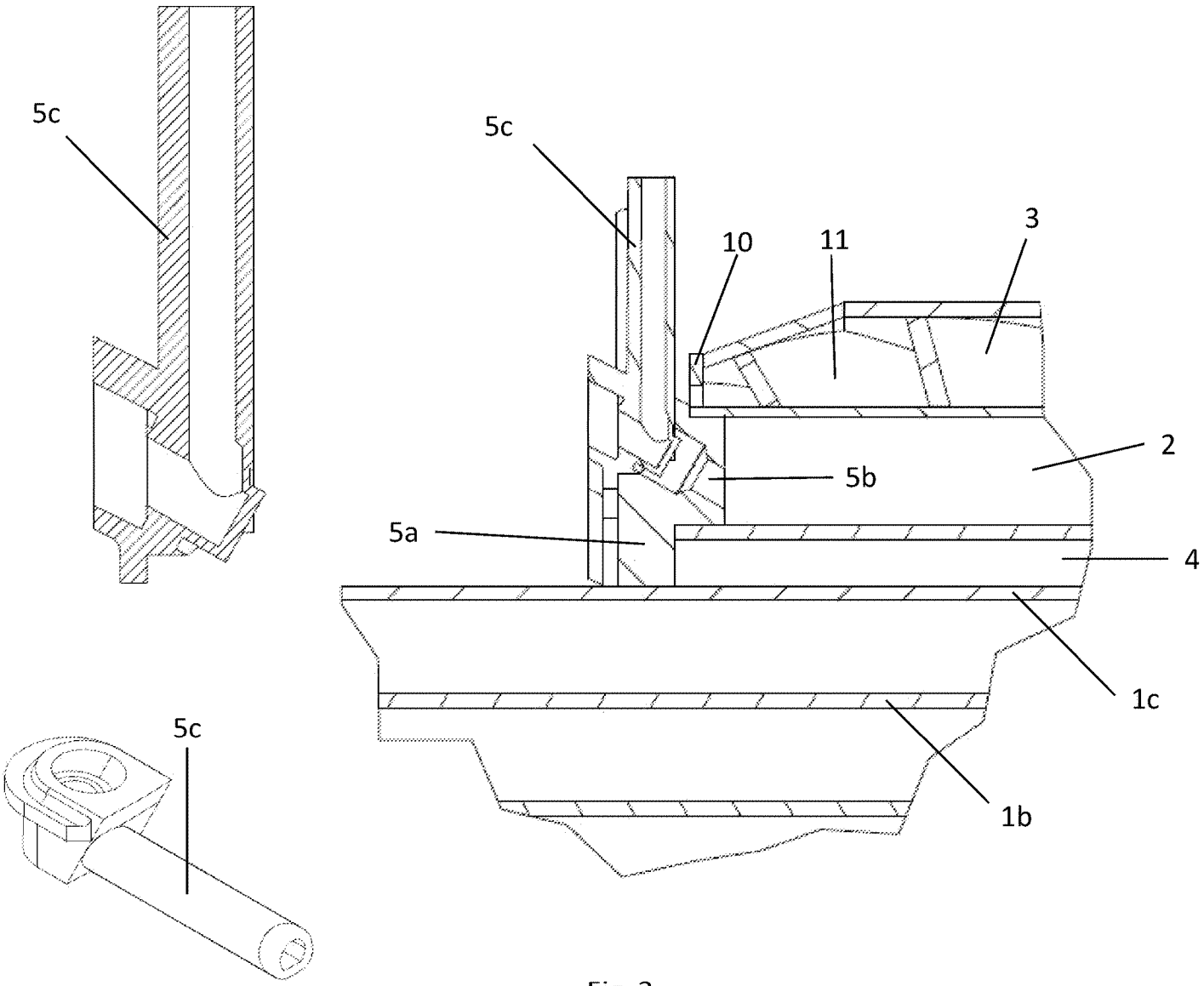
FIG. 2 depicts a cross section of a nozzle construction of the invention.
Figure 3:
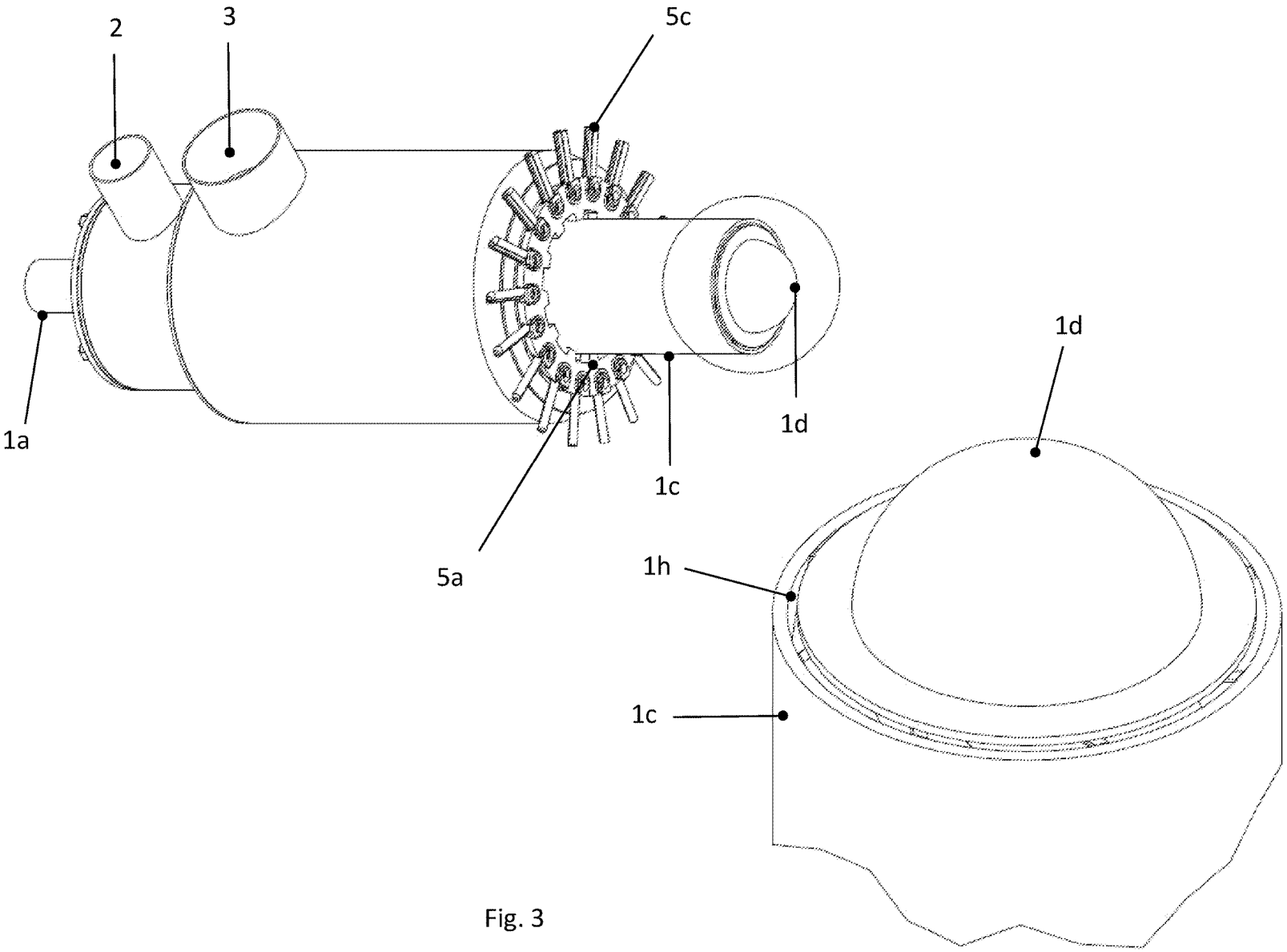
FIG. 3 depicts a burner of the invention with an axial outflow of secondary air into the hot gas zone.
Figure 4:
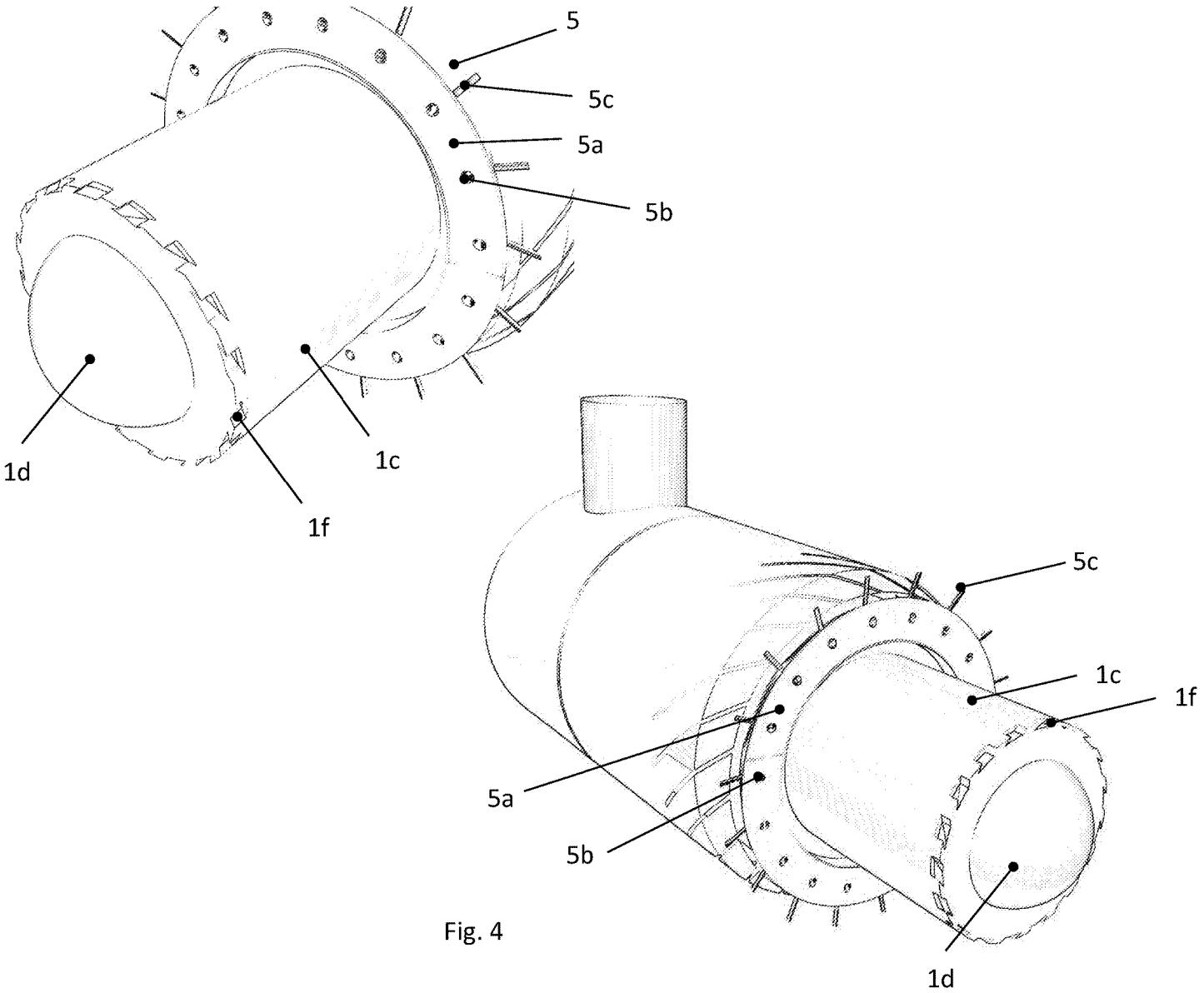
FIG. 4 depicts a three-dimensional view of a burner of the invention.
Figure 5:
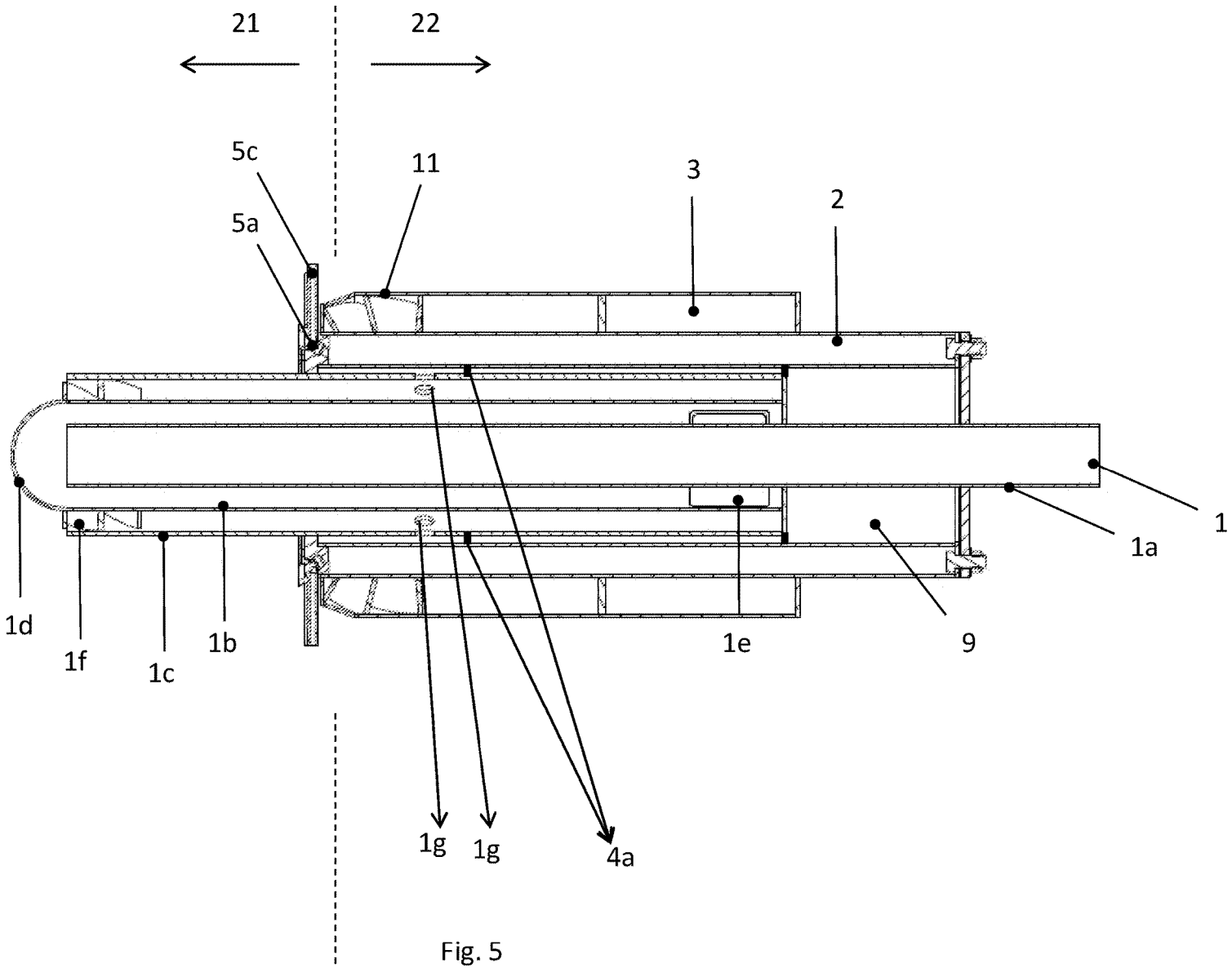
FIG. 5 depicts an embodiment of the invention with overflow openings and partitions.
Figure 6:
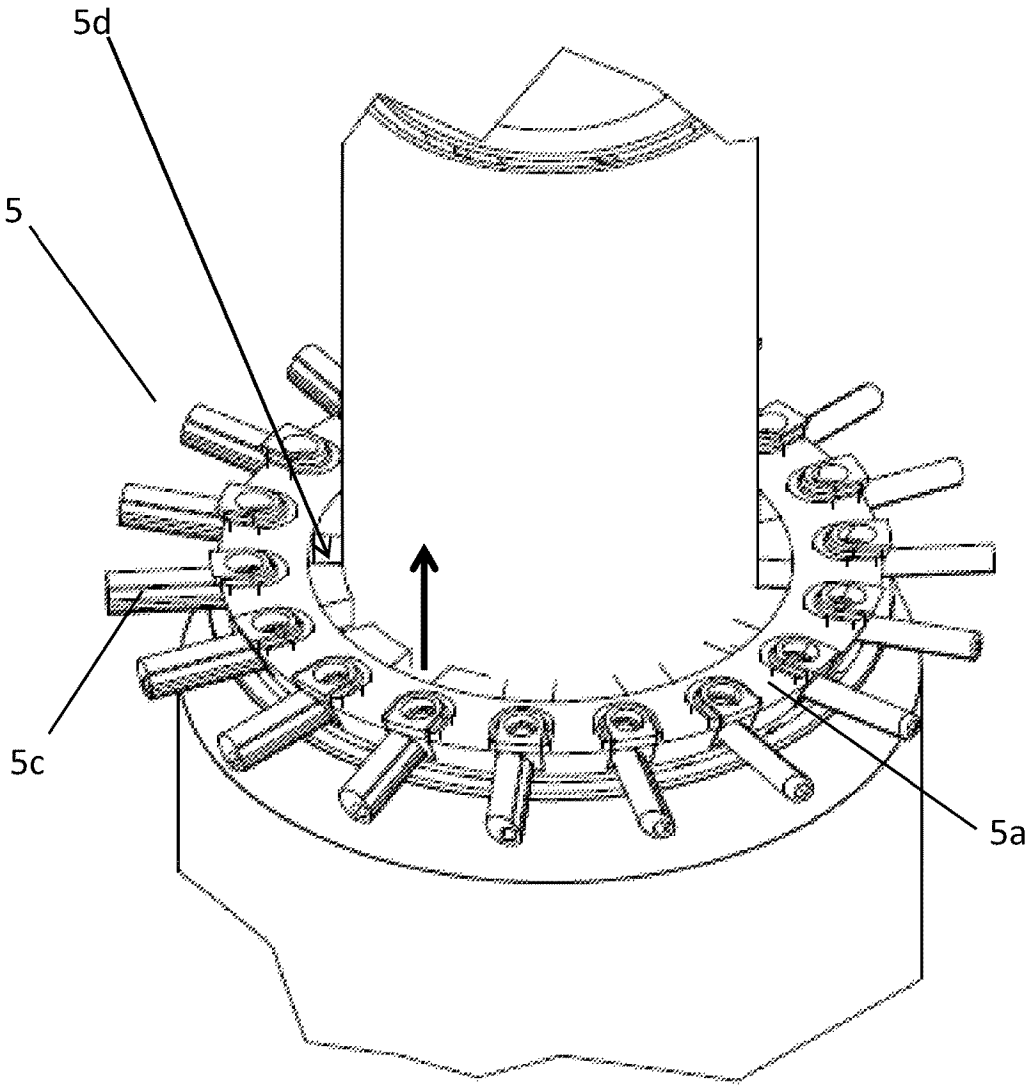
FIG. 6 depicts a nozzle construction of an embodiment of the invention.
Figure 6:
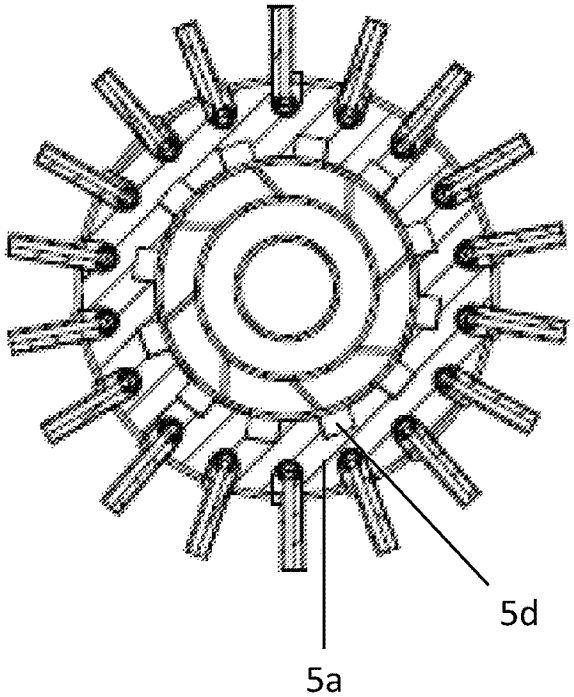
Figure 7:
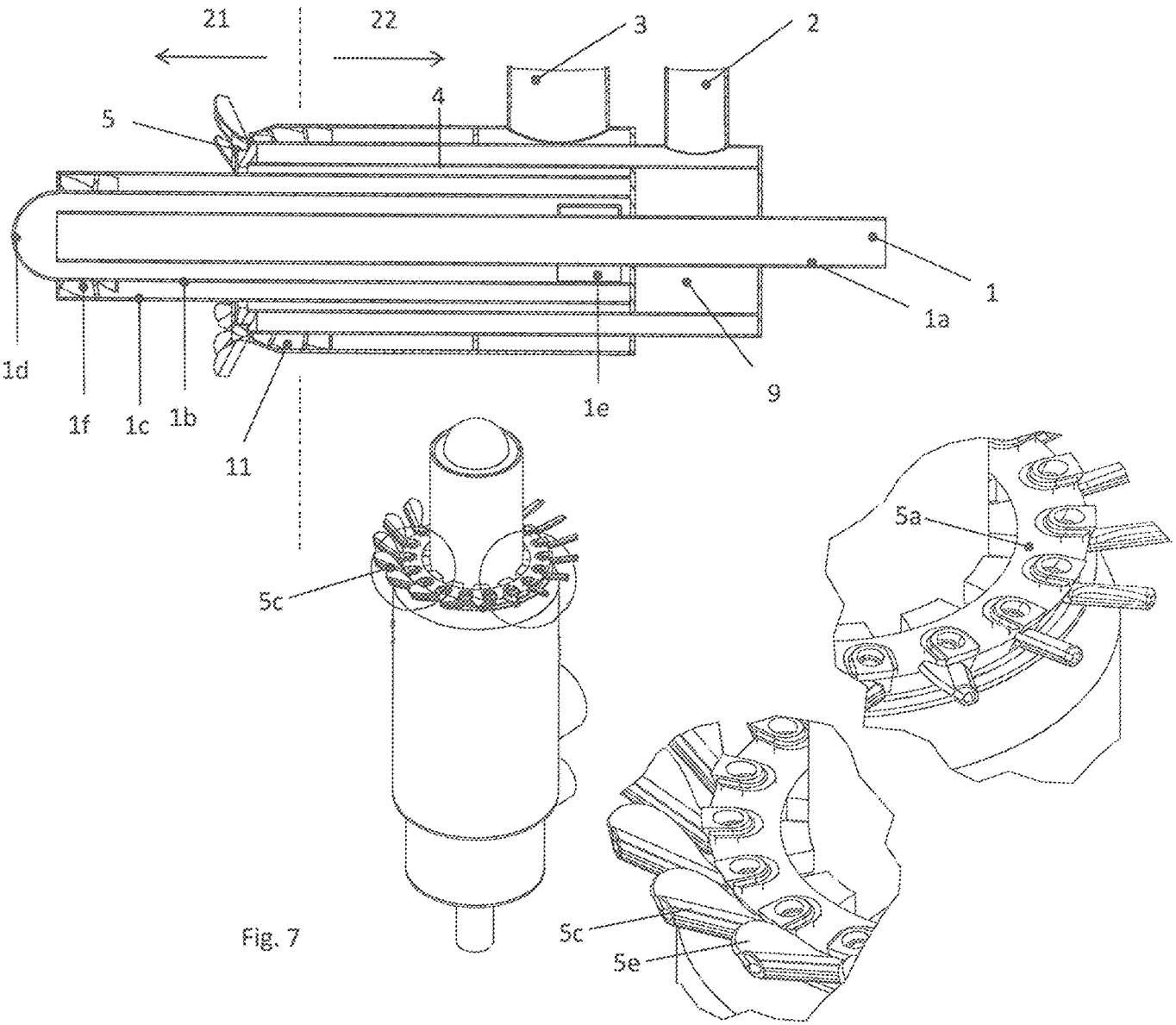
FIG. 7 depicts another embodiment of the invention with integrated guide plates on the injector aspiration nozzles.
Figure 8:
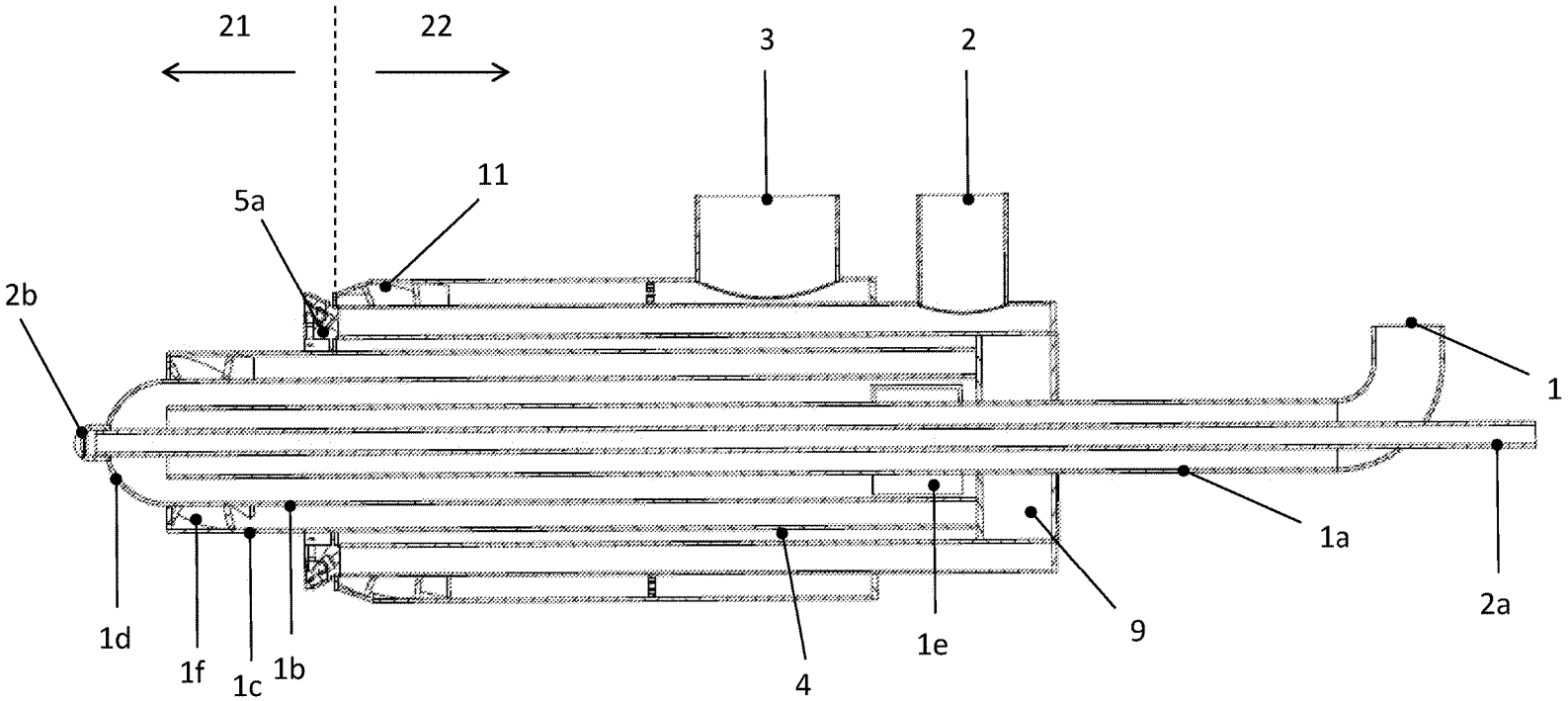
FIG. 8 depicts yet another embodiment of the invention with a supply line for additives.
Figure 8:
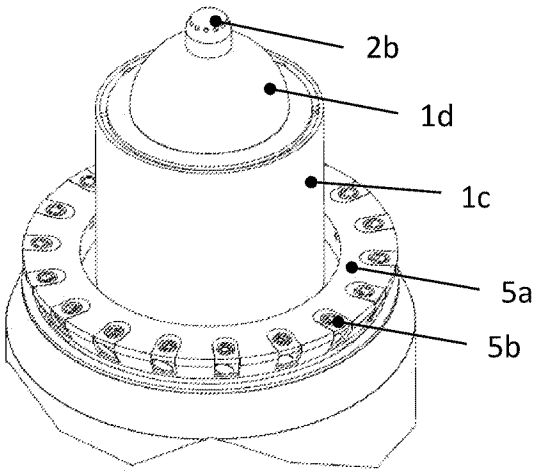
Figure 9:
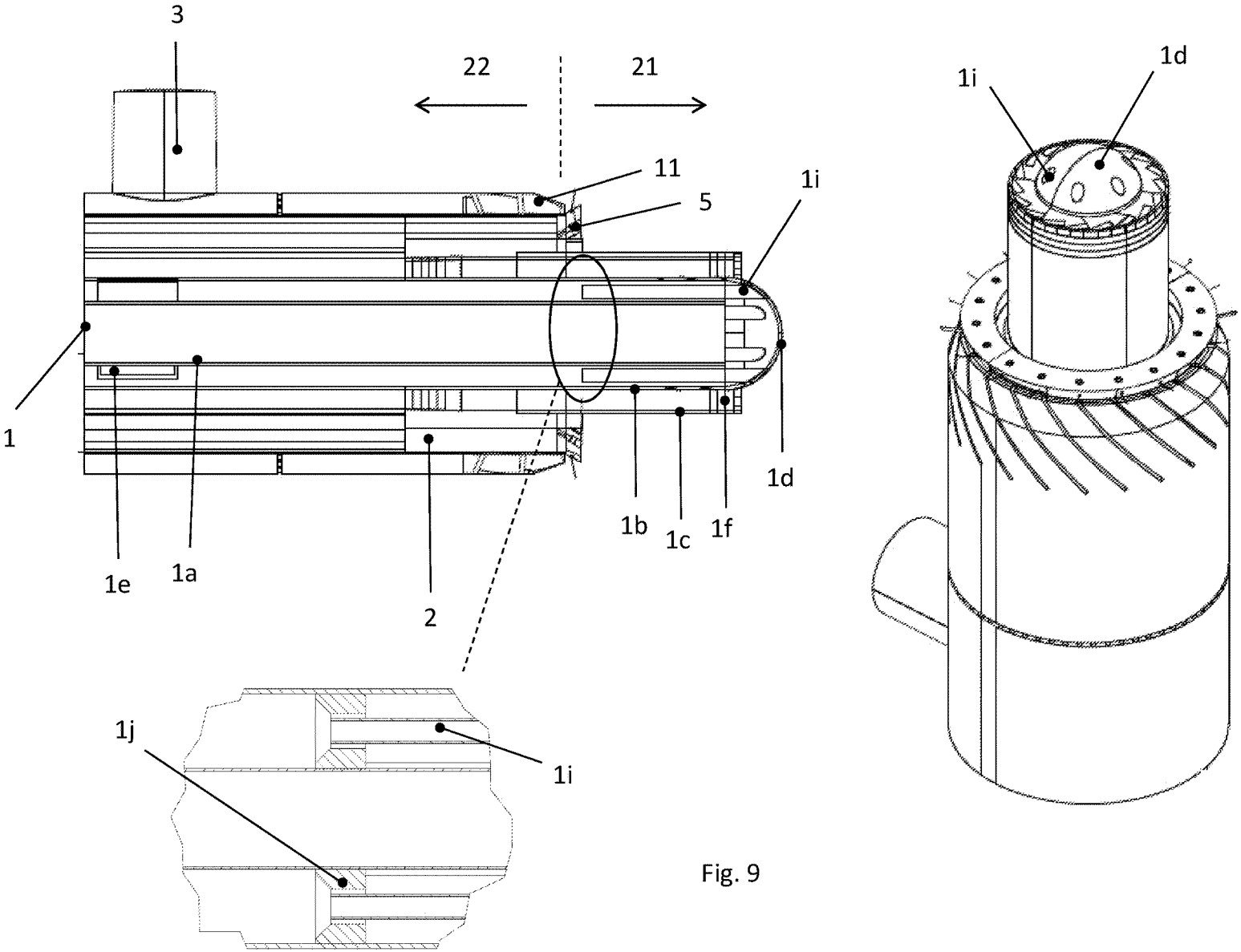
FIG. 9 depicts yet another embodiment of the invention with injector aspiration tubes for mixing in exhaust gas from the combustion chamber into the secondary airstream.
Figure 10:
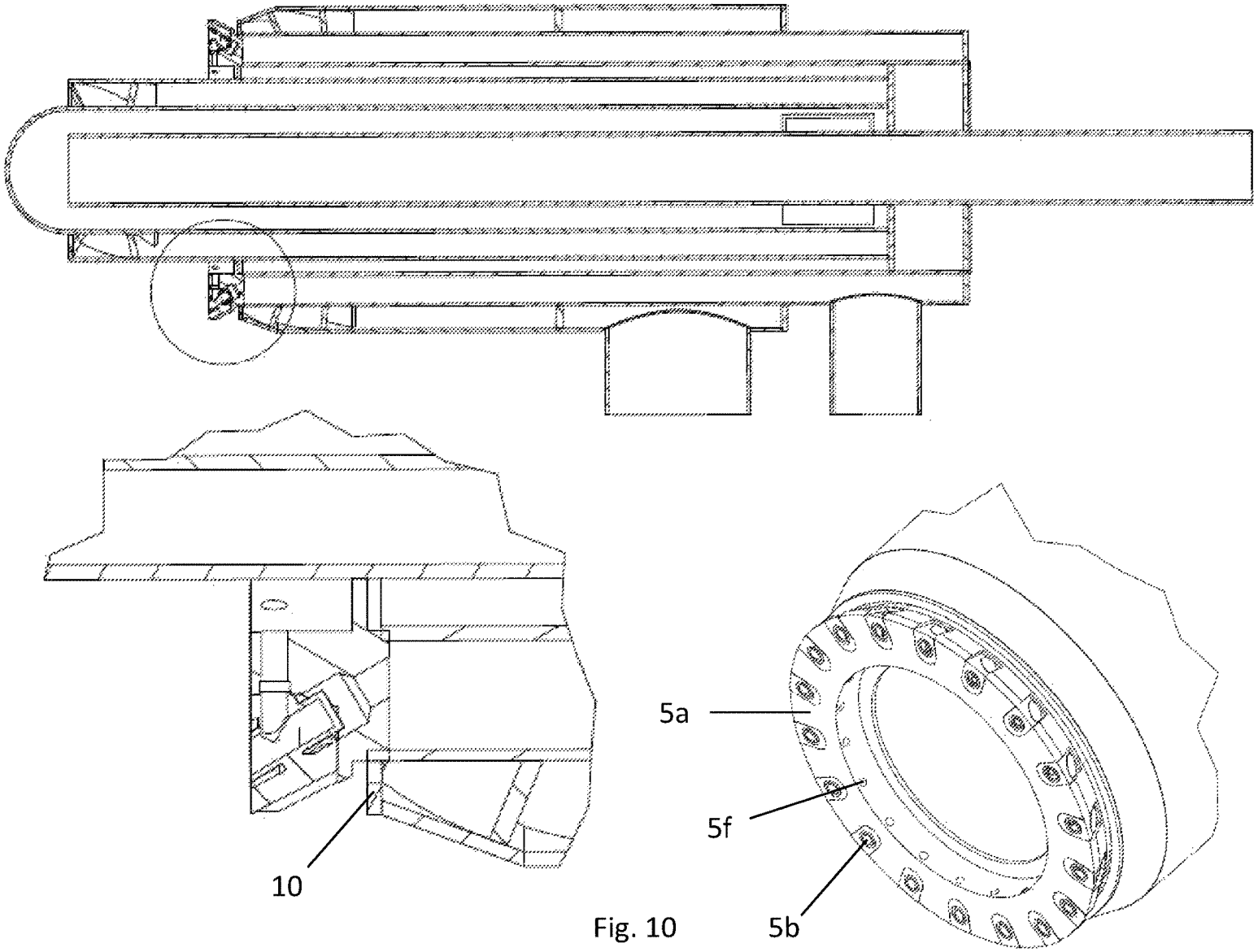
FIG. 10 depicts yet another embodiment of the invention with an adjustable ring diaphragm in the primary air feed line.
Figure 11:
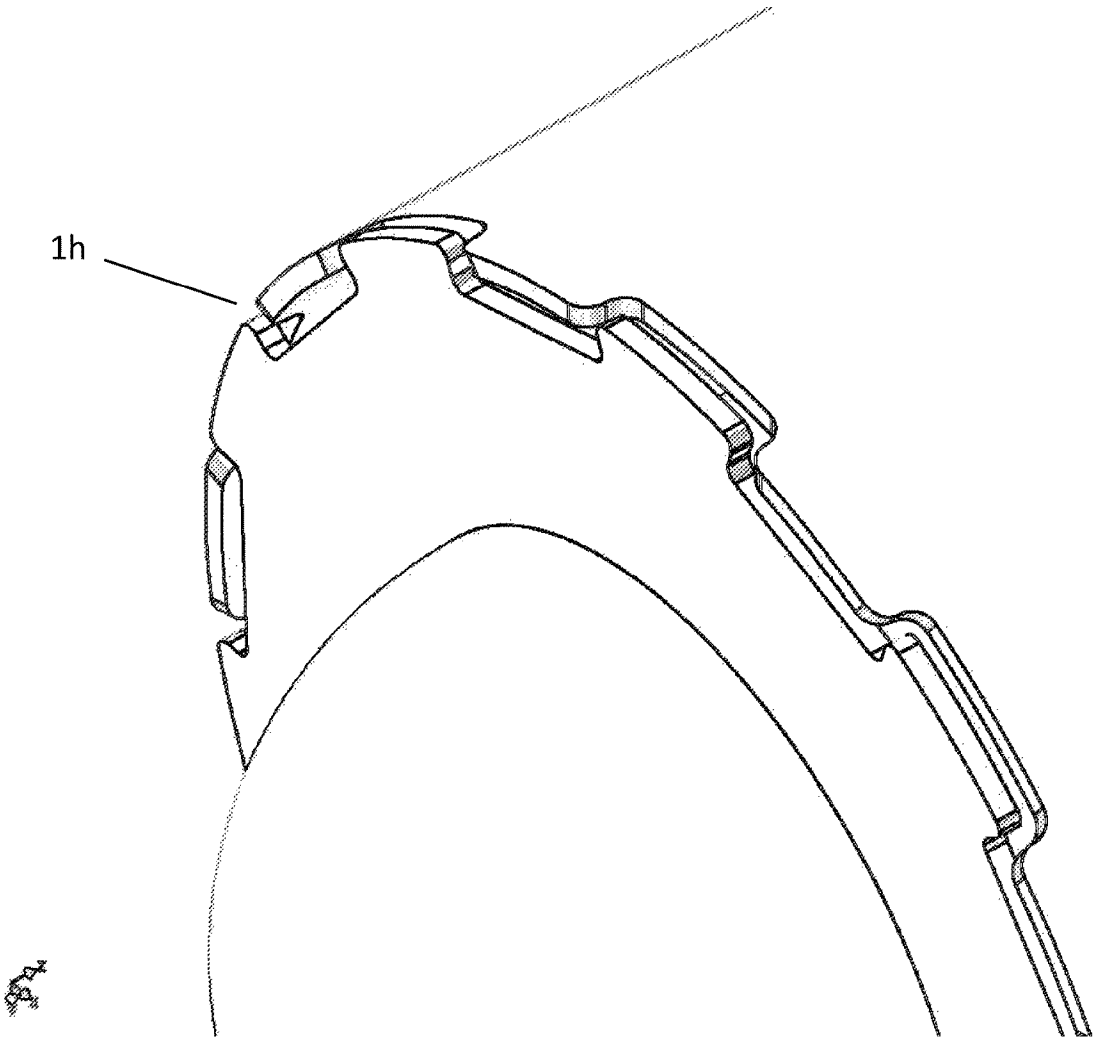
FIG. 11 depicts a serrated nozzle gap that allows secondary air to flow out both axially and radially in relation to the longitudinal axis.
Figure 12:
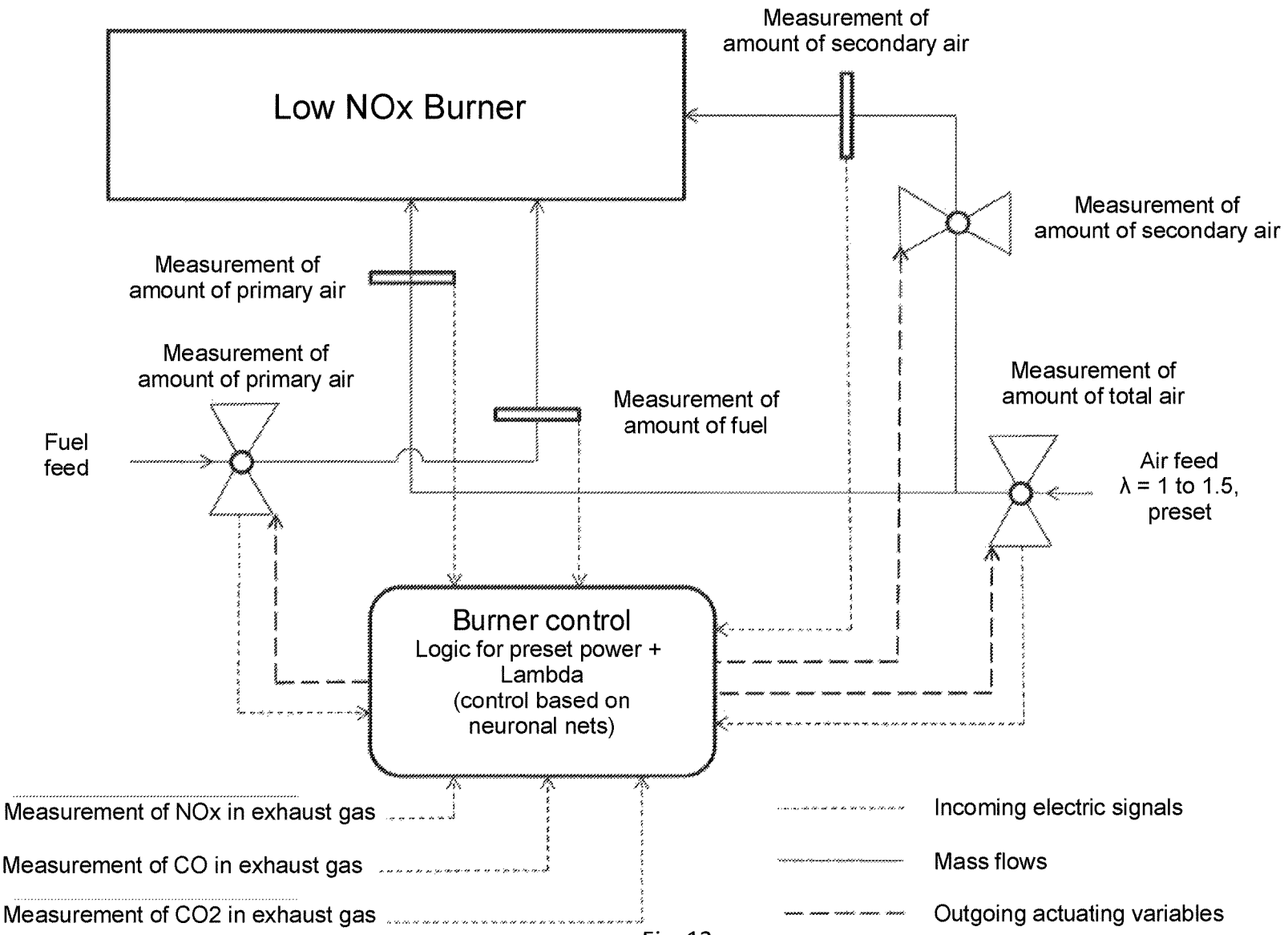
FIG. 12 depicts a control concept for regulating the Low NOX burner.
Figure 13:
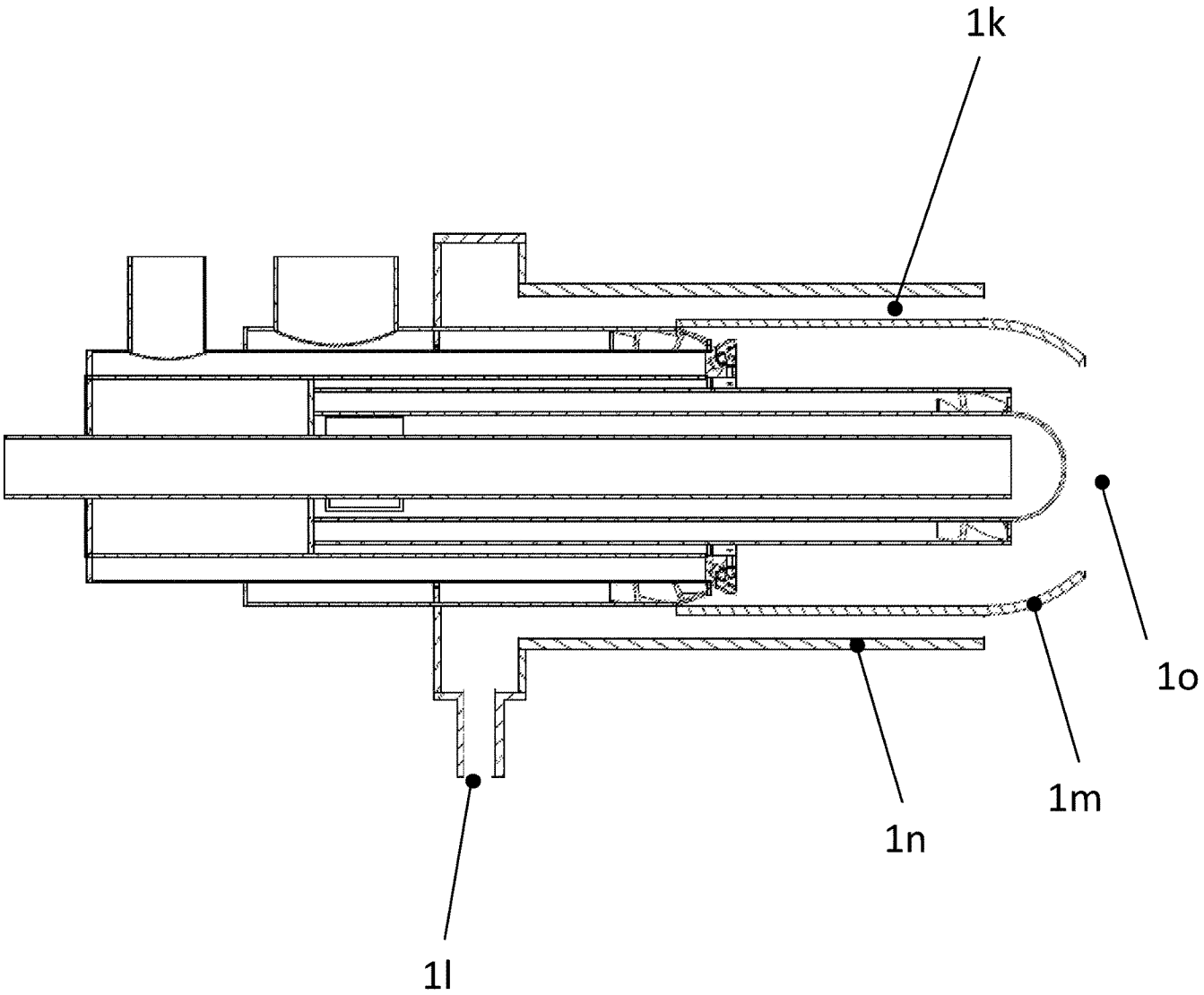
FIG. 13 depicts another embodiment of the invention.

A burner according to the invention comprises a hot gas zone 21 and an outer zone 22, a primary air feed line 3, a secondary air feed line 1, a fuel feed line 2, wherein the secondary air feed line 1 comprises three concentric cylindrical tubes, an innermost tube 1*a*, a middle tube 1*b* and an outermost tube 1*c*, wherein:

the secondary air feed line 1 protrudes into the hot gas zone 21;

the innermost tube 1*a* is open to the outer zone 22 and open to the hot gas zone 21;

the middle tube 1*b* is arranged concentrically around the innermost tube 1*a* and has a dome-shaped seal 1*d*, which encloses the innermost tube 1*a* on the hot gas side 21 dome-like and is closed off towards the outer zone 22;

the middle tube 1*b* comprises overflow channels 1*e*, which are arranged in the outer zone 22, comprise holes and are open towards the outermost tube 1*c;* the outermost tube 1*c* is closed off towards the outer zone 22 and open to the hot gas side 21 and comprises adjustable swirl vanes 1*f* near the opening on the hot gas side 21 at an angle of attack of 40°;

the fuel feed line 2 is arranged concentrically around the secondary air feed line 1, which ends immediately after entering the hot gas zone 21;

wherein a first dead volume 4 exists inside the burner between the secondary air feed line 1 and the fuel feed line 2, and wherein the fuel feed line 2 has a nozzle construction 5 on the hot gas side 21, which comprises the following:

a ring diaphragm 5*a* with holes 5*b;* radially oriented injector aspiration nozzles 5*c*, which are in fluid connection with the holes 5*b* and, on the aspiration side, project beyond the outer diameter of the primary air feed line 3;

wherein the holes 5*b* in the ring diaphragm 5*a* have an angle of attack of 45°, wherein the ring diaphragm 5*a* forms a truncated cone with an angle of attack of 30°, wherein the base of the cone faces the outer zone 22;

a second dead volume 9 is arranged between the secondary air feed line 1 and the fuel feed line 2 on the side of the outer zone 22;

the primary air feed line 3 is arranged concentrically around the fuel feed line 2, which ends immediately after entering the hot gas zone 21 and comprises the following:

a conical taper of the diameter at the opening on the hot gas side 21, wherein the conical taper forms a truncated cone with an angle of 10°;

an adjustable ring diaphragm 10 at the opening of the conical taper facing the hot gas side 21;

swirl vanes 11 with adjustable angle of attack, arranged at an angle of 55°.

The secondary air feed line 1*a*, 1*b*, 1*c* is adjustable in length. About ⅓ of the secondary air feed line 1 protrudes into the hot gas zone 21.

The ratio of outer diameter of the innermost tube 1*a* of the secondary air feed line:outer diameter of the middle tube 1*b* of the secondary air feed line:outer diameter of the outermost tube 1*c* of the secondary air feed line 1 is about 1:1.8:2.6.

The second dead volume 9 is about ⅕ of the length of the secondary air feed line 1.

The ratio of inner diameter of fuel feed line 2:outer diameter of fuel feed line 2 is about 1:1.4.

The ratio of inner diameter of primary feed line 3:outer diameter of primary air fuel line 3 is about 1:1.3.

The first dead volume 4 has vacuum or thermal insulation.

Example 2—Burner with Overflow Channels and Adjustable Nozzle Ring

The burner as described in example 1 is modified as follows: the outermost tube of the secondary air feed line 1*c* comprises overflow channels 1*g*, which end in the first dead volume 4, and the first dead volume 4 comprises partitions 4*a*, which reduce the first dead volume 4, and the ring diaphragm 5*a* is adjustable and comprises openings 5*d* on its inside.

Example 3—Burner with Guide Plates

The burner as described in example 1 or example 2 is modified as follows: the radially oriented injector aspiration nozzle 5*c* comprises at least one guide plate 5*e* with the same orientation as the swirl vane 11 in the primary air feed line 3.

Example 4—Burner with Nozzle Ring with Radially Oriented Outflow Openings

The burner as described in any one of the above examples has the following modification: the outermost tube of the secondary air feed line 1*c* comprises a nozzle ring 1*h* with radially or radially and axially oriented outflow openings at the outlet into the hot gas zone 21.

Example 5—Burner with Tube Segments in the Dome-Shaped Seal

The burner as described in any one of the above examples has the following modification: tube sections 1*i* are arranged in the dome-shaped seal 1*d* of the middle tube of the secondary air feed line 1*b*, which project through the dome-shaped seal 1*d* on one end and project through a baffle plate 1*j* on the opposite end.

Example 6—Burner with a Central Additives Feed Line

The burner as described in any one of the above examples has the following modification: an additives feed line 2*a* is arranged centrally along the burner axis and projects through the dome-shaped seal of the middle tube of the secondary air feed line 1*d*, wherein the feed line 2*a* comprises a nozzle 2*b* in the hot gas zone 21.

Example 7—Method

In a burner as described in any one of the examples 1 to 6, secondary air is fed into the secondary air feed line 1, wherein the secondary air is swirled by the swirl vanes 1*f*; fuel is fed into the fuel feed line 2, wherein the fuel is injected through the holes in the ring diaphragm 5*a* at an outwardly directed angle of attack into the swirled primary air; primary air is fed into the primary air feed line 3, wherein the primary air is swirled by the swirl vanes 11.

The portion of secondary air is 40% by volume and the portion of primary air is 60% by volume of all air required for combustion.

The total air coefficient for the sum of primary and secondary air $\lambda$ is about 1.1.

The primary air and secondary air are a mixture of air and exhaust gas.

The fuel is natural gas.

Exhaust gas is directly aspirated into the fuel stream due to the injector effect.

The outwardly directed injector aspiration nozzles 5*c* are cooled by the outflowing primary air.

The quantities of material flows are controlled on the basis of a rigidly functioning programmed logic for low NOx and CO emissions.

The invention claimed is:

1. A burner, comprising a hot gas side (21) and an outer zone (22), a primary air feed line (3), a secondary air feed line (1), a fuel feed line (2), wherein, the secondary air feed line (1) comprises three concentric cylindrical tubes (an innermost tube (1*a*), a middle tube (1*b*) and an outermost tube (1*c*)), wherein:

the secondary air feed line (1) protrudes into the hot gas side (21);

the innermost tube (1*a*) is open to the outer zone (22) and open to the hot gas side (21);

the middle tube (1*b*) is arranged concentrically around the innermost tube (1*a*) and has a dome-shaped seal (1*d*), which encloses the innermost tube (1*a*) on the hot gas side (21) and is closed off towards the outer zone (22);

the middle tube (1*b*) comprises overflow channels (1*e*), which are arranged in the outer zone (22), comprise holes and are open towards the outermost tube (1*c*);

the outermost tube (1*c*) is closed off towards the outer zone (22) and open to the hot gas side (21) and comprises adjustable swirl vanes (1*f*) near the opening on the hot gas side (21) at an angle of attack of 15° to 80°;

wherein tube sections (li) are arranged in the dome-shaped seal (1*d*) of the middle tube of the secondary air feed line (1*b*), which project through the dome-shaped seal (1*d*) on one end and project through a baffle plate (1*j*) on the opposite end;

the fuel feed line (2) is arranged concentrically around the secondary air feed line (1), which ends immediately after entering the hot gas side (21);

wherein a first dead volume (4) exists inside the burner between the secondary air feed line (1) and the fuel feed line (2) and wherein the fuel feed line (2) has a nozzle construction (5) on the hot gas side (21), which comprises the following:

a ring diaphragm (5*a*) with holes (5*b*);

radially oriented injector aspiration nozzles (5*c*), which are in fluid connection with the holes (5*b*) and, on the aspiration side, project beyond the outer diameter of the primary air feed line (3);

wherein the holes (5*b*) in the ring diaphragm (5*a*) have an angle of attack of 0°-60°, wherein the ring diaphragm (5*a*) forms a truncated cone with an angle of attack of 0°-70°, wherein the base of the cone faces the outer zone (22);

a second dead volume (9) is arranged between the secondary air feed line (1) and the fuel feed line (2) on the outer side zone (22);

the primary air feed line (3) is arranged concentrically around the fuel feed line (2), which ends immediately after entering the hot gas side (21) and comprises the following:

a conical taper of the diameter at the opening on the hot gas side (21), wherein the conical taper forms a truncated cone with an angle of 0°-20°;

an adjustable ring diaphragm (10) at the opening of the conical taper facing the hot gas side (21);

swirl vanes (11) with adjustable angle of attack, arranged at an angle of 10° to 90°.

2. The burner according to claim 1, wherein, the secondary air feed line (1*a*, 1*b*, 1*c*) is adjustable in length, wherein the tube-in-tube system for supplying the secondary air projects with a length L into the combustion chamber, wherein the length L according to the relation L=D*f with D=outer diameter of the primary air feed line and f can have a value of $0 \leq f \leq 3$, or projects approx. ⅓ of the secondary air feed line (1) into the hot gas side (21).

3. The burner according to claim 1, wherein the ratio of ADi: ADm:ADa is approx. 0.7-1.3:1.26-2.34:1.82-3.38, wherein ADi represents the outer diameter of the innermost secondary air feed line (1*a*), ADm represents the outer diameter of the middle secondary air feed line (1*b*) and ADa represents the outer diameter of the outermost secondary air feed line (1*c*).

4. The burner according to claim 1, wherein the ratio of IDZ: ADZ is approx. 0.7-1.3:0.98-1.82, wherein IDZ represents the inner diameter of the fuel feed line (2) and ADZ represents the outer diameter of the fuel feed line (2).

5. The burner according to claim 1, wherein the ratio of IDP: ADP is approx. 0.7-1.3:0.91-1.69, wherein IDP represents the inner diameter of the primary air feed line (3) and ADP represents the outer diameter of the primary air feed line (3).

6. The burner according to claim 1, wherein the outermost tube of the secondary air feed line (1*c*) comprises overflow channels (1*g*), which discharge into the first dead volume (4), and the first dead volume (4) comprises partitions (4*a*), which reduce the first dead volume, and the ring diaphragm (5*a*) is adjustable and comprises openings (5*d*) on the inside.

7. The burner according to claim 1, wherein the radially oriented injector aspiration nozzle (5*c*) comprises at least one guide plate (5*e*) with the same orientation as the swirl vane (11) in the primary air feed line (3).

8. The burner according to claim 1, wherein the outermost tube of the secondary air feed line (1*c*) comprises a nozzle ring (1*h*) with radially or radially and axially arranged outflow openings at the outlet into the hot gas side (21).

9. The burner according to claim 1, wherein the cross section of the fuel-filled ring diaphragm (5*a*) has an outwardly directed cone via which the primary air flows.

10. The burner according to claim 1, wherein holes (5*f*) are arranged on the inside of the ring diaphragm (5*a*), which are in fluid connection with the holes in the ring diaphragm (5*b*).

11. The burner according to claim 1, wherein a feed line for additives (2*a*) is arranged centrally along the burner axis and projects through the dome-shaped seal of the middle tube of the secondary air feed line (1*d*), wherein the feed line (2*a*) comprises a nozzle (2*b*) in the hot gas side (21).

12. The burner according to claim 1, wherein the outflow openings of the tube sections (1*i*) on the side of the baffle plates (1*j*) can be narrowed by a longitudinally adjustable cone (valve).

13. The burner according to claim 1, wherein an outer annular gap (1*k*) is formed by two tubes (1*m*, 1*n*), which surround the burner on the outside, wherein the inner one of the two tubes (1*m*) has an opening (10) and the outer one of the two tubes (1*n*) has an outlet (1*l*).

14. A method for the combustion of fuel, wherein, in a burner according to claim 1, secondary air is fed into the secondary air feed line (1), wherein the secondary air is swirled by the swirl vanes (1*f*);

fuel is fed into the fuel feed line (2), wherein the fuel is injected through the holes in the ring diaphragm (5*a*) at an outwardly directed angle of attack into the swirled primary air;

primary air is fed into the primary air feed line (3), wherein the primary air is swirled by the swirl vanes (11);

wherein the portion of secondary air is about 20-50% by volume and the portion of primary air may be 50-80% by volume of all air required for combustion.

15. The method according to claim 14, wherein, the total air coefficient for the sum of primary and secondary air λ is about 1.0 to 2.0; and/or the oxygen concentration in the secondary air and primary air is between 21% by volume and 100% by volume; and/or the primary air and secondary air is a mixture of air and exhaust gas, a mixture of air and oxygen or a mixture of exhaust gas and oxygen.

16. The method according to claim 14, wherein the fuel comprises nitrogen compounds, gaseous hydrocarbons, hydrogen, biogas, mixtures of carbon dust and air, hydrogen sulfides, carbon monoxide, mixtures of carbon monoxide and hydrogen, coke-oven gas, tail gas or mixtures thereof.

17. The method according to claim 14, wherein exhaust gases are aspirated into the fuel stream due to the injector effect.

18. The method according to claim 14, wherein the outwardly directed injector aspiration nozzles (5*c*) are cooled by the outflowing primary air;

wherein the aspirated exhaust gas flow is cooled below condensation temperature (dew point) for the exhaust gas humidity inside the injector aspiration nozzles (5*c*), wherein water is condensed in the exhaust gas flow and the liquid water is fed into the fuel stream.

* * * * *